US009309615B2

(12) United States Patent
Heβ et al.

(10) Patent No.: US 9,309,615 B2
(45) Date of Patent: Apr. 12, 2016

(54) WATER-CONDUCTING HOUSEHOLD APPLIANCE HAVING A ROTATABLE COMPONENT

(75) Inventors: Jürgen Heβ, Berlin (DE); Petra Pfister, Schönwalde (DE); Vladimir Proseanic, West Bloomfield, MI (US); Svetlana Visnepolschi, West Boomfield, MI (US)

(73) Assignee: BSH Hausgeräte GmbH, Munich (DE)

( * ) Notice: Subject to any disclaimer, the term of this patent is extended or adjusted under 35 U.S.C. 154(b) by 915 days.

(21) Appl. No.: 13/532,883

(22) Filed: Jun. 26, 2012

(65) Prior Publication Data

US 2013/0340486 A1 Dec. 26, 2013

(51) Int. Cl.
*D06F 37/20* (2006.01)

(52) U.S. Cl.
CPC ..... *D06F 37/20* (2013.01)

(58) Field of Classification Search
CPC ..... D06F 37/00; D06F 37/20; F16J 15/32; B60K 17/04; F16H 57/00; F16C 33/80
USPC ..... 277/562
See application file for complete search history.

(56) References Cited

U.S. PATENT DOCUMENTS

| | | | | |
|---|---|---|---|---|
| 3,259,393 | A * | 7/1966 | Dega | 277/559 |
| 3,572,730 | A | 3/1971 | Otto et al. | |
| 3,586,342 | A | 6/1971 | Staab Justice, III | |
| 3,785,660 | A | 1/1974 | Bush | |
| 3,913,925 | A * | 10/1975 | Gyory | 277/559 |
| 4,695,063 | A | 9/1987 | Schmitt et al. | |
| 4,709,930 | A | 12/1987 | Forch | |
| 5,711,534 | A | 1/1998 | Bengoa et al. | |
| 6,276,691 | B1 * | 8/2001 | Nishigaki | F16J 15/3244 264/161 |
| 2005/0098959 | A1 * | 5/2005 | Uhrner | 277/500 |
| 2011/0018209 | A1 | 1/2011 | Dahlhaus-preussler | |

FOREIGN PATENT DOCUMENTS

| | | | |
|---|---|---|---|
| DE | 4123392 | A1 | 1/1993 |
| EP | 0874078 | A2 | 10/1998 |
| GB | 475195 | | 11/1937 |

OTHER PUBLICATIONS

DE4123392 raw machine translation.*
European Search Report EP 13 17 2243 dated Sep. 19, 2013.

* cited by examiner

*Primary Examiner* — Michael Barr
*Assistant Examiner* — Rita Adhlakha
(74) *Attorney, Agent, or Firm* — Nixon & Vanderhye, P.C.

(57) ABSTRACT

A water-conducting household appliance having a rotatable component, which is rotatably mounted on a stationary component of the household appliance by way of a bearing formed from a metallic material, and having a sealing element, by means of which the bearing is sealed off from a liquid chamber of the household appliance, wherein a contact surface of the sealing element is in contact with a contact surface of a shaft part which is connected to the moveable component and can be rotated relative to the sealing element, and slides on the contact surface of the shaft part. A pump is on at least one of the contact surfaces, by means of which liquid can be conveyed out of an intermediate space embodied between the respective contact surfaces in the direction of the liquid chamber when rotating the rotatable component.

26 Claims, 5 Drawing Sheets

WATER-CONDUCTING HOUSEHOLD APPLIANCE HAVING A ROTATABLE COMPONENT

BACKGROUND OF THE INVENTION

The invention relates to a water-conducting household appliance having a rotatable component, which is rotatably mounted on a stationary component of the household appliance by way of a bearing formed from a metallic material. The household appliance also includes a sealing element, by means of which the bearing is sealed off from a liquid chamber of the household appliance, wherein a contact surface of the sealing element is brought into contact with a contact surface of a shaft part which is connected to the moveable component and can be rotated relative to the sealing element, and slides on the contact surface of the shaft part.

Interest presently focuses in particular on a household appliance for the care of items of laundry, in which the laundry drum is rotatably mounted on a wash tub by way of a bearing. The bearing, for instance a ball-bearing, is usually located inside a bearing chamber, which is separated for liquids from the interior of the wash tub with the aid of a sealing element or sealed off from the interior of the wash tub. It is prior art that the bearing chamber is filled with lubricating oil or lubricating grease. The lubricating oil or lubricating grease in this case assumes two different functions, namely on the one hand the function of lubricating the metallic ball bearing and on the other hand also the function of keeping water from the ball bearing. The metallic ball bearing namely represents a component which is sensitive to corrosion. The bearing chamber, as already explained, is separated for liquids from the wash tub, which can be filled with water, by means of the sealing element, but the possibility of individual droplets of water entering the bearing chamber over the entire service life of the household appliance cannot be excluded.

A schematic representation of internal components of a washing machine known from prior art is shown in FIG. 1. A laundry drum 3 is used to receive items of laundry and is rotatably mounted about an axis of rotation 4 running horizontally. The laundry drum 3 is connected to a pulley 6 by way of a shaft 5. While the laundry drum 3 is disposed within a stationary wash tub 7, the pulley 6 is disposed outside of the wash tub 7. The laundry drum 3 here represents a moveable component of the washing machine, and the wash tub 7 represents a stationary component of the washing machine.

The laundry drum 3 is rotatably mounted on the wash tub 7. To this end, a bearing device 8 is provided, which includes a bearing housing 9 and a bearing 10 arranged in the bearing housing 9. The bearing 10 is for instance a ball bearing. An enlarged representation of the bearing device 8 is shown schematically in FIG. 2. The bearing 10 is in a bearing chamber 11, which is filled with lubricating oil 12. The bearing chamber 11 is sealed off from the interior 14 of the wash tub 7 and/or the interior of the laundry drum 3 by means of a sealing element 13. The interior 14 in this case represents a liquid chamber, in which water can be received. The sealing element 13 is provided in the form of a circumferential shaft sealing ring, which is embodied in the shape of an L in the longitudinal section and includes a annular element 15 running radially, from which two lips protrude in the axial direction in the region of the shaft 5, namely on the one hand a first lip 16 in the direction of the interior 14 and also on the other hand a second lip 17 in the direction of the bearing chamber 11. While the first lip 16 rests directly on the shaft 5 and thus prevents the penetration of water into the bearing chamber 11, the second lip 17 rests on a sliding ring and/or sleeve 18 in the radial direction, which is connected to the shaft 5 and is sealed with an O-ring 19 at an end facing the interior 14. The sealing effect of the second lip 17 is enhanced by a circumferential spiral spring 20.

Even with a particularly reliably sealed bearing chamber 11 of this type, it is not possible, throughout the entire service life of the washing machine, to exclude droplets of water being able to reach the bearing chamber 11 by 100%. For the formation of rust on the ball bearing, three conditions must simultaneously be fulfilled: metal (for instance iron), water and oxygen must be present. Rust in this case refers to a complex corrosion product which is produced from iron by oxidation with oxygen in the presence of water. Rust is therefore an oxide of the iron which contains water, namely an agglomeration of iron, oxide and hydroxide ions with water. With respect to the formation of rust, reference is made to FIG. 3, in which a component 1 formed from iron Fe corrodes on account of a droplet of water 2 present. If the iron component 1 comes into contact with water, damp air or another electrolyte, the oxygen dissolved in the water attacks the metal, which is referred to as oxidation. A galvanic cell is formed, so that electrons are removed from the metal and the positively charged ions pass into the solution. Thus the metal corrodes. This is particularly disadvantageous in a washing machine. A thus corroded bearing leads to a marked development of noise in the washing machine, namely in particular during spinning. This frequently results in unnecessary costs, since the entire bearing can only be replaced with a relatively large outlay.

BRIEF SUMMARY OF THE INVENTION

An object of the invention is to demonstrate a solution as to how the bearing can be particularly reliably protected from corrosion in a household appliance of the type cited in the introduction.

An inventive water-conducting household appliance thus includes a rotatable component, for instance a laundry drum, which is rotatably mounted on a stationary component, for instance a wash tub, of the household appliance by way of a bearing formed from a metallic material (for instance iron). The bearing is generally prone to corrosion. The household appliance also includes a sealing element, by means of which the bearing is sealed off from a liquid chamber of the household appliance. A radial contact surface of the sealing element is brought into contact with a radial contact surface of a shaft part which is connected to the moveable component and can be rotated relative to the sealing element and slides on this contact surface of the shaft part. In accordance with the invention, provision is made for a structure, also referred to below as the pump structure, to be embodied on a contact surface, by means of which liquid can be conveyed out of an intermediate space embodied between the respective contact surfaces axially in the direction of the liquid chamber when rotating the rotatable component. The specific pump structure is defined in more detail by means of the advantageous developments described below.

The inventive effect is therefore achieved in that the liquid penetrating into the intermediate space is once again conveyed back into the liquid chamber with the aid of the pump structure, namely on account of an adhesion in conjunction with the guidance through the pump structure. The invention in this way utilizes the rotational energy, by means of which the liquid can be conveyed out of the intermediate space between the respective contact surfaces in the direction of the liquid chamber. To this end, only the generation of a force component in the direction of the liquid chamber is needed, in other words a force component in an axial direction. This force component is generated on one of the contact surfaces with the aid of the pump structure, in other words with the aid of a special profile on the sealing element. It is possible in this way to reliably protect the metallic bearing from corrosion, so that the development of noise in the household appliance can be prevented through its entire service life.

It has proven particularly advantageous if the household appliance is a device for the care of items of laundry, namely in particular a washing machine, a tumble dryer or a washer-dryer. The rotatable component is then a laundry drum for receiving items of laundry. By contrast, the stationary component may be a wash tub, which is used as the liquid chamber to receive water. In such household appliances, the metallic bearing should be protected particularly reliably.

The bearing is sealed off from the liquid chamber by means of the sealing element. Here the bearing is preferably in a bearing chamber, which is separated for liquids from the liquid chamber with the aid of the sealing element. Water is therefore essentially prevented from flowing into the bearing chamber from the liquid chamber. Indeed, it is not possible to completely rule out that droplets of water enter the bearing chamber, but in this case the pump structure nevertheless assumes the function of protecting the metallic bearing from corrosion. The pump structure completely prevents water from being able to reach the bearing chamber.

It has proven particularly advantageous for the pump structure to include a guide embodied as a radial depression, by way of which the liquid can be guided out of the intermediate space to the liquid chamber in a targeted fashion. A plurality of such guides can overall be embodied on the contact surface, by way of which the droplets of water can be explicitly routed back into the liquid chamber. The guide extends in a preferably spiral fashion both in the axial direction on the one hand and also in the peripheral direction on the other hand, so that when rotating the rotatable component, a force component is generated in the axial direction during the adhesion, by means of which the liquid is guided and/or conducted into the liquid chamber. With the aid of a guide embodied as a depression, it is possible for the liquid to be conducted particularly reliably and effectively into the liquid chamber.

It is preferable that the contact surface of the sealing element whereon the pump structure is embodied. This embodiment can be implemented without any great outlay; only the sealing element needs to be provided with a corresponding pattern and/or profile and the shaft part need not be redesigned in a complicated fashion. Furthermore, the attachment of a pump structure to the sealing element in comparison with a corresponding pump structure on the shaft part is more cost-effective.

Provision may basically be made for the pump structure to function uni-directionally only, in other words solely when rotating the component in a specific direction. In this case, the pump structure can be formed by spiral-type structure elements, which extend on the contact surface obliquely in the axial direction and in the peripheral direction. Because one exemplary application nevertheless relates in particular to a washing machine, measures are taken in an exemplary embodiment to ensure that when rotating the component in both directions, in other words independently of the direction of rotation, the liquid is conveyed out of the intermediate space in the direction of the liquid chamber in each instance. The metallic bearing is thus particularly reliably protected, irrespective of the current direction of rotation of the rotatable component.

In an exemplary embodiment, the pump structure includes a plurality of structure elements arranged in a distributed fashion on the contact surface and protruding from the contact surface, between which guides are embodied to guide the liquid to the liquid chamber. In particular, the plurality of structure elements is arranged to be distributed both in the axial direction and in the peripheral direction. It is thus possible to configure guides in the contact surface which, independently of the current direction of rotation of the rotatable component, ensure that a force component is generated in the axial direction and the liquid is conveyed back into the liquid chamber.

In another exemplary embodiment, the structure elements each include two radial walls, which are joined at a pointed end of the respective structure element which points the pointed end in the axial direction toward the liquid chamber. This provides for generation of a force component in the axial direction with minimal technical outlay, indeed in particular independently of the current direction of rotation.

Provision is made in an exemplary embodiment for the pump structure to include at least two rows of structure elements arranged annularly distributed in the peripheral direction and for the structure elements of one of the rows to overlap one with the structure elements of the other adjacent rows in the peripheral direction. This implies that the structure elements of the one row are arranged adjacent to the structure elements of the other row in the peripheral direction. In other words, the structure elements of the one row are arranged interlocked with the structure elements of the other row. Spiral-shaped guides can therefore simultaneously be provided both in the form of a left-handed thread and also in the form of a right-handed thread and the liquid is also prevented from reaching the metallic bearing.

In an exemplary embodiment, provision is made for the shaft part to be a shaft which is connected to the rotatable component and the contact surface of the sealing element rests directly on an outer periphery of the shaft. The use of an additional sleeve and/or a sliding ring (cf. the reference numeral 18 in FIG. 2) with the disadvantages associated therewith relating to the costs as well as the valuable installation space is therefore unnecessary. The assembly of the sealing element is therefore also clearly simpler than with the arrangement according to FIG. 2.

Further features of the invention result from the claims, the figures of the drawing and the description of the figures. All features and feature combinations cited in the description and the features and feature combinations cited below in the description of the figures or shown in isolation in the figures cannot only be used in the respectively specified combination but also in other combinations or even in isolation.

BRIEF DESCRIPTION OF THE DRAWINGS

The invention is now explained in more detail by means of individual exemplary embodiments, and also with reference to the appended drawings, wherein.

DETAILED DESCRIPTION OF EXEMPLARY EMBODIMENTS OF THE PRESENT INVENTION

Figure 1:
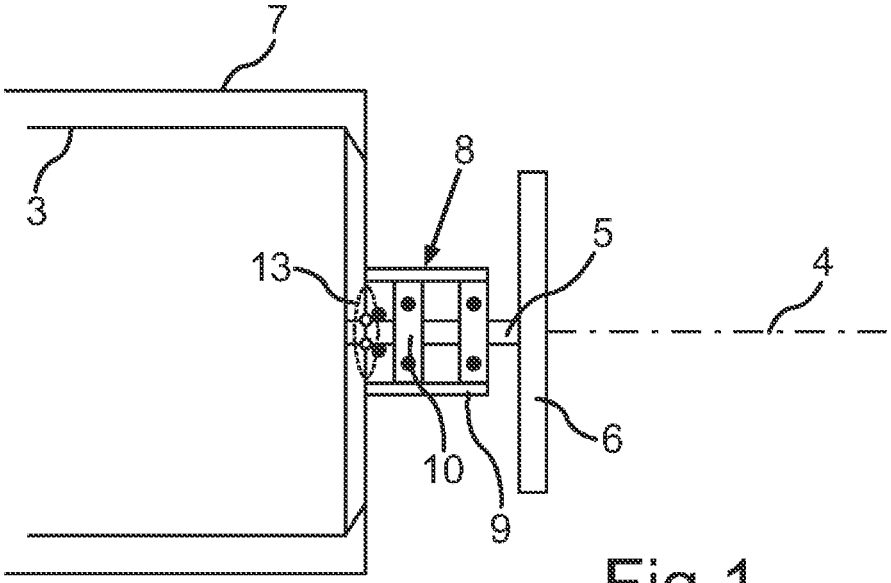
Fig.1 (Prior Art)
FIG. 1 shows a schematic representation of internal components of a washing machine according to the prior art.

Identical or functionally identical elements are provided with the same reference numerals.

Figure 4:
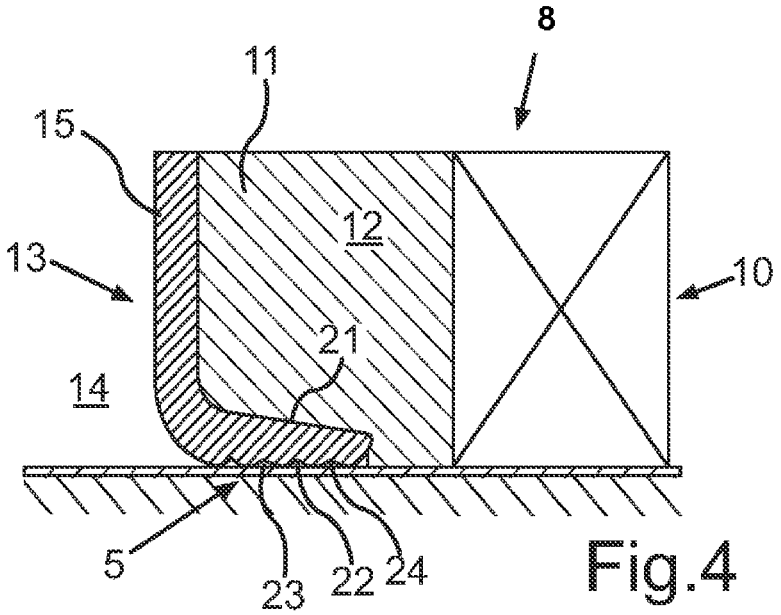
FIG. 4 shows a schematic representation of a bearing device having a sealing element of a household appliance according to an embodiment of the invention and FIGS. 5 to 9 show schematic representations of different embodiments and/or profiles of a pump structure, which is embodied on a contact surface of the sealing profile, wherein the respective feed device of the liquid is shown for each two different directions of rotation of a laundry drum.

FIG. 4 shows a bearing device 8 of a washing machine. The bearing device 8 includes a bearing 10, namely in particular a ball-bearing. The bearing 10 is arranged in a bearing chamber 11, which is filled with lubricating oil or grease 12. The bearing chamber 11 is sealed off from the interior 14 of the wash tub 7 with the aid of a sealing element 13, which in the exemplary embodiment is embodied as a shaft seal and/or shaft sealing ring. The sealing element 13 is made of PTFE or a comparable material for example and has a lower friction factor and a high durability or stability.

Figure 2:
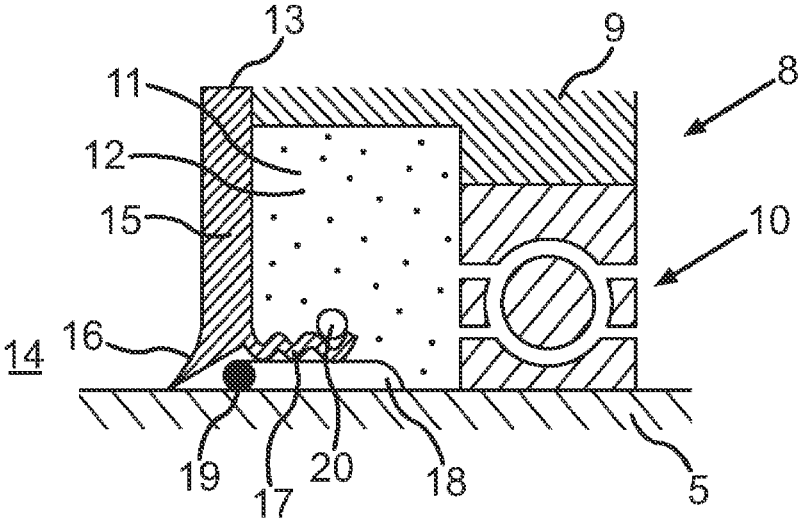
Fig.2 (Prior Art)
FIG. 2 shows a schematic representation of a bearing device, as provided in the washing machine according to the prior art.
Figure 3:
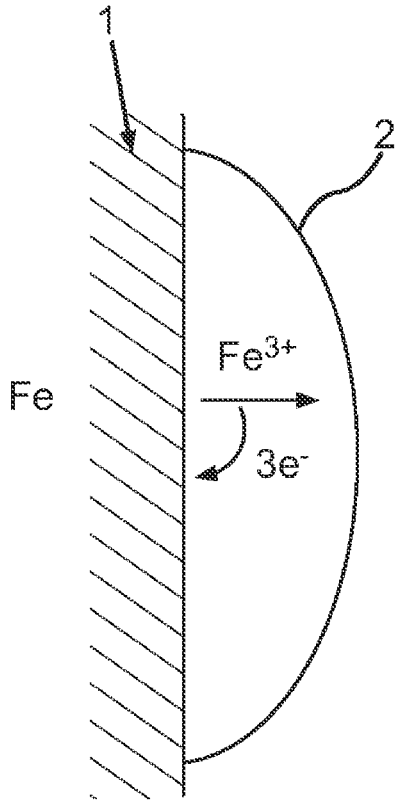
Fig.3 (Prior Art)
FIG. 3 shows a schematic representation to explain the formation of corrosion.

The sealing element 13 is embodied as an L-shape in its longitudinal section and includes an annular element 15 extending in the radial direction, from which, in the axial direction, a sealing foot 21 protrudes from the interior space 14. The sealing foot 21 extends here in parallel to the shaft 5 of the laundry drum 3 and thus at right angles to the annular element 15. The sealing foot 21 of the individual region of the sealing element 13, which is brought into contact with the shaft 5, dispenses with an additional lip pointing in the direction of the interior 14. Here a sliding ring and/or a sleeve 18 (see FIG. 2) are dispensed with, so that the sealing foot 21 rests directly on the shaft 5 and slides thereupon. The sealing foot 21 on the one hand as well as the shaft 5 on the other hand includes respective contact surfaces 22, and 23, which are brought into contact with one another. This means that the contact surface 22 of the sealing foot 21 rests on the contact surface 23 of the shaft 5. At least one of the contact surfaces 22 and 23 is provided with a pump structure 25, which enables the liquid penetrating into an intermediate space 24 between the contact surfaces 22, 23 to be conveyed out of this intermediate space 24 back in the direction of the interior 14. For instance, the cited pump structure 25 is embodied on the contact surface 22 of the sealing foot 21, whereas the outer periphery, in other words the contact surface 23 of the shaft 5, is free of such a pump structure 25.

FIGS. 5 to 9 show schematic representations of different embodiments of such pump structure 25. A feed direction 26 and/or the respective feed path of the liquid is also shown in each instance in FIGS. 5 to 9, namely in each instance for two different directions of rotation, which are referred to with reference numeral 27. The direction of rotation 27 indicated with an arrow relates in each instance to the direction of motion and/or direction of rotation of the shaft 5, wherein the pump structure 25 shown is embodied on the stationary sealing foot 21. The direction of rotation 27 also simultaneously means the peripheral direction, whereas the axial direction is indicated with 28. The radial direction corresponds here to the direction at right angles to the drawing plane.

In other words, the respective figures a indicate the feed direction 26 in a first direction of rotation of the laundry drum, whereas the respective figures b for the same pump structure 25, represent the feed direction 26 with an opposite second direction of rotation of the laundry drum.

The pump structure 25 is provided in each instance as a regular, grid-type pattern and/or profile, which includes a plurality of structure elements 29. The pump structure 25 includes here a plurality of rows 30, which are formed from a plurality of structure elements 29 arranged in an annularly distributed fashion in the peripheral direction. Provision can also be made here for the structure elements 29 of one row 30 to overlap with the structure elements 20 of the respective adjacent row 30 in the peripheral direction and/or to be arranged adjacent to one another in the peripheral direction. Viewed in the axial direction 28, several such rows 30 can be provided overall, namely for instance three or four or five or six rows. The respective axially adjacent rows 30 are also arranged offset relative to one another about a structure element 29 in the peripheral direction so that the structure elements 29 of one row 30 can extend into the intermediate areas between the structure elements 29 of the adjacent row 30.

Common to the pump structures 25 is that the structure elements 20 are embodied as protrusions 20, so that guides 31 are embodied between the structure elements 29, through which the liquid can be conveyed in the direction of the interior 14. The structure elements 29 also include two radial walls 32, 33, which are joined at a pointed tip and/or a pointed end 34, which points in the direction toward the interior 14. It is thus always ensured that independently of the respective direction of motion 27 of the shaft 5, a force component is generated in the direction of the interior 14, through which the liquid is conveyed out of the intermediate space 24 to the laundry drum 3, namely solely on account of the rotational energy of the shaft 5 and on account of the adhesion.

A plurality of guides and/or channels 31 are thus provided, which run spirally both in the sense of a right-handed thread and also in the sense of a left-handed thread, and thus produce a flow of water in the direction of the interior 14 independently of the current direction of rotation of the laundry drum 3.

Figure 5A:
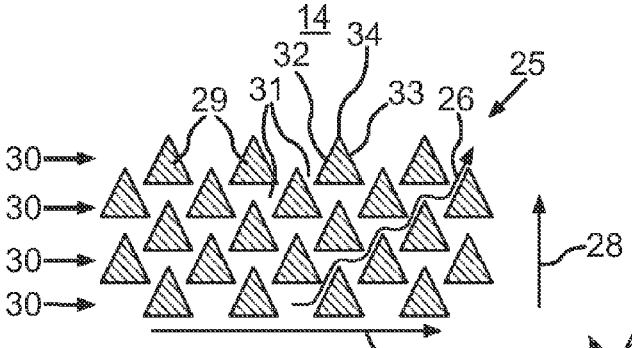
Figure 5B:
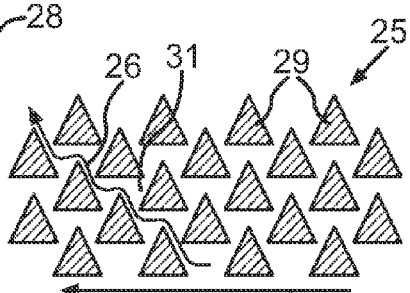

FIG. 5 shows a pump structure 25, the structure elements 20 of which are embodied each in the shape of a triangle. This embodiment is relatively simple to implement and enables a reliable flow of liquid out of the intermediate space 24 into the interior 14 of the laundry drum 3, in other words to the liquid chamber. The respective peaks of the triangle which point in the direction of the interior 14 protrude here into the intermediate areas, which are embodied in each instance between two adjacent structure elements 29 of the axially adjacent row 30.

Figure 6A:
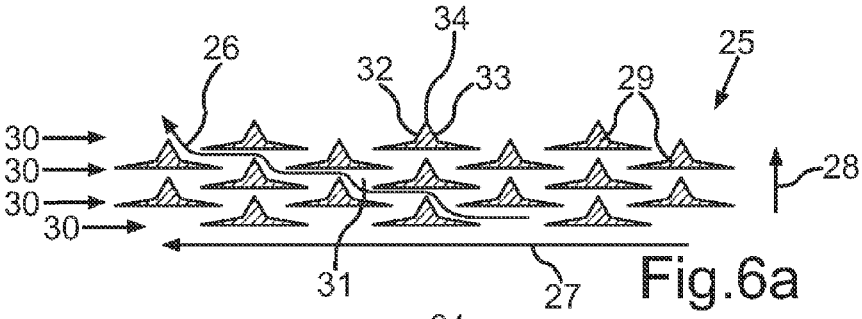
Figure 6B:
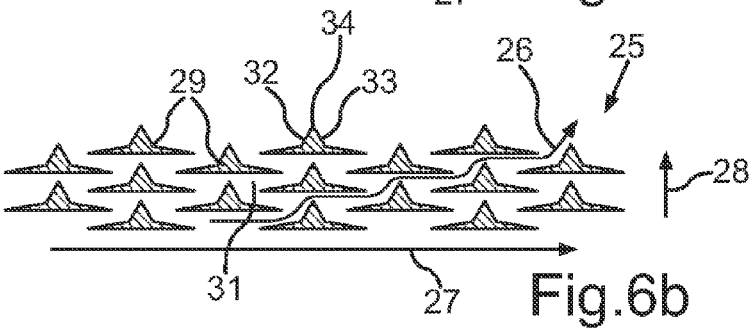
Figure 9A:
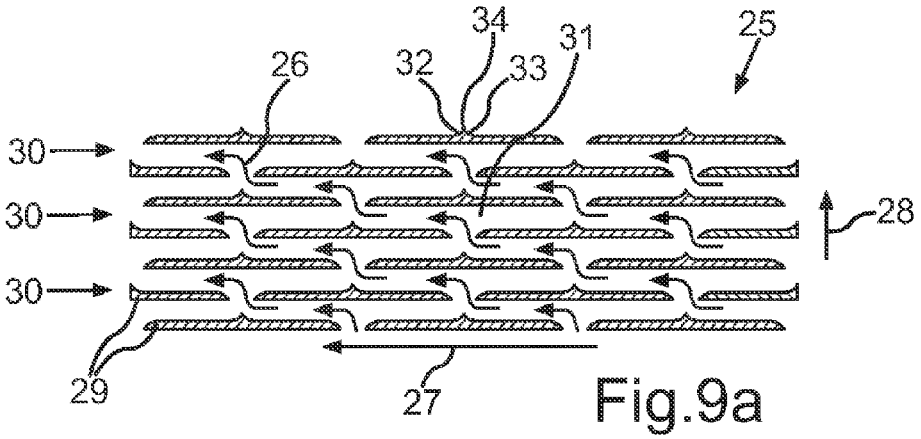
Figure 9B:
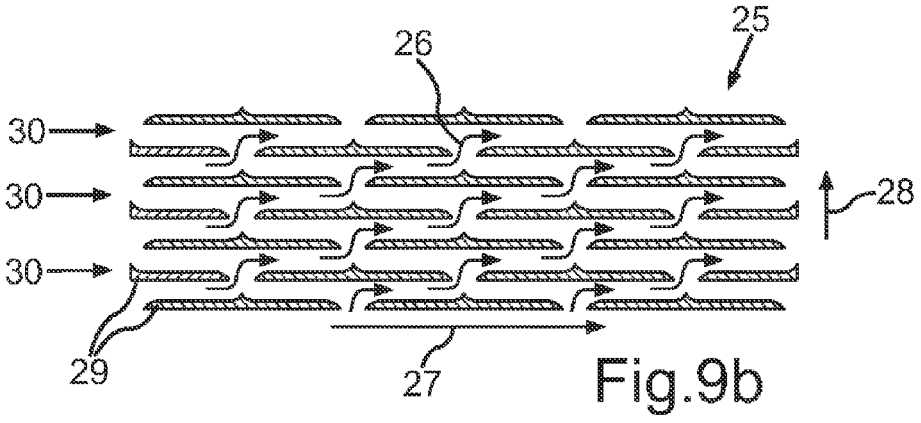

Pump structures 25 are shown in FIGS. 6 and 9, which have proven particularly advantageous if relatively minimal installation space is available in the axial direction 28. The structure elements 29 are here namely embodied relatively flat in the axial direction.

Figure 7A:
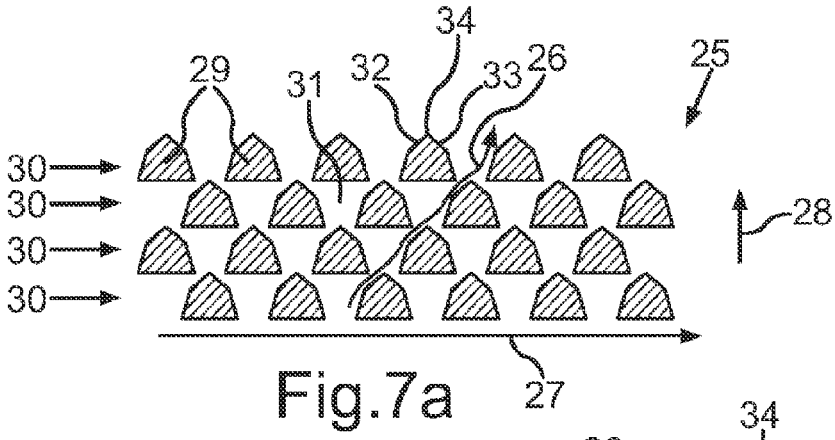
Figure 7B:
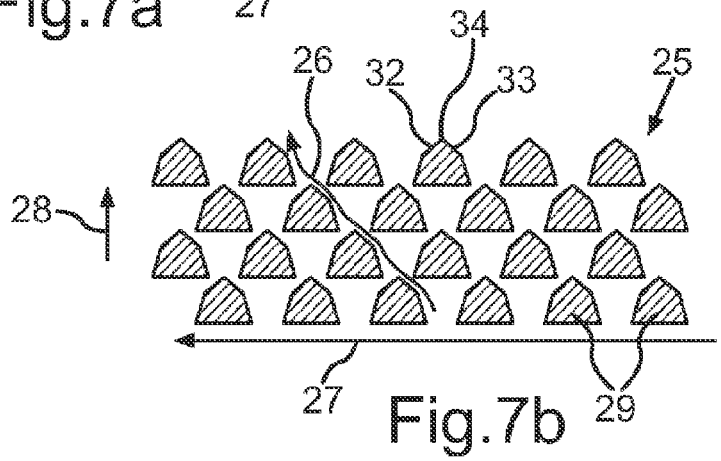
Figure 8A:
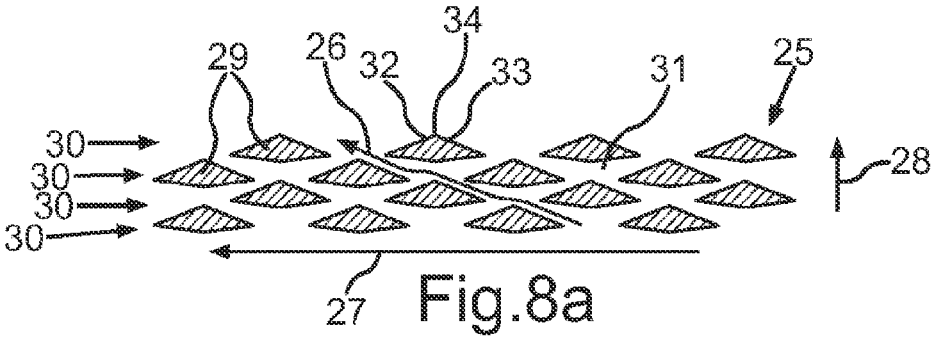
Figure 8B:
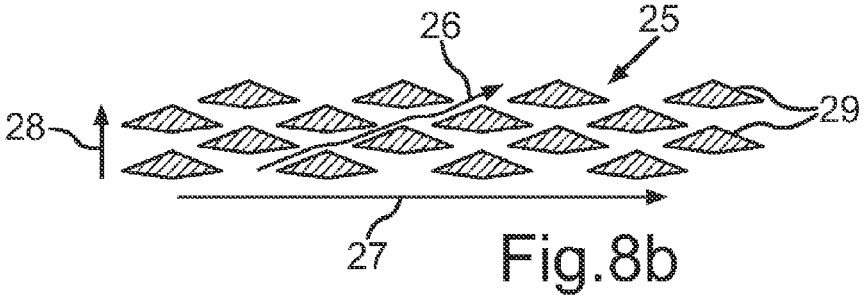

The pump structure 25 shown in FIG. 7 includes structure elements 29, which are embodied as pentangles. By contrast, the structure elements 29 of the pump structure 25 are embodied as rectangles in accordance with FIG. 8. By comparison with the structure elements 29 according to FIG. 6, the structure elements 29 according to FIGS. 7 and 8 also feature fewer sharp edges, as a result of which the fluid dynamics is in this case particularly good.

What is claimed is:

1. A water-conducting household appliance comprising:

a liquid chamber;

a stationary component;

a metallic bearing;

a rotatable component rotatably mounted on the stationary component of the household appliance by the metallic bearing;

a shaft connected to the rotatable component, the shaft having a shaft contact surface;

a seal structured to seal the metallic bearing from the liquid chamber, the seal comprising a seal contact surface in contact with the shaft contact surface, wherein the shaft is rotatable relative to the seal such that the seal contact surface slides on the shaft contact surface; and a pump structure configured to convey liquid from an intermediate space between the seal contact surface and the shaft contact surface to the liquid chamber upon rotation of the rotatable component, wherein the pump structure further comprises a plurality of elements provided on at least one of the shaft contact surface and the seal contact surface, wherein each of the plurality of elements comprises two radial walls converging toward one another in a direction of the liquid chamber, wherein the plurality of elements are arranged in at least two rows adjacent one another, and wherein the plurality of elements in each row of the at least two rows are staggered relative to the plurality of elements in each adjacent row.

2. The household appliance of claim 1, wherein the pump comprises a radial depression guide structured to conduct liquid out of the intermediate space to the liquid chamber.

3. The household appliance of claim 1, wherein the plurality of elements are formed on the seal contact surface.

4. The household appliance of claim 1, wherein the pump is structured to convey liquid out of the intermediate space in the direction of the liquid chamber when the rotatable component is rotated in either of two directions of rotation.

5. The household appliance of claim 1, wherein the pump further comprises guides defined between the plurality of elements that are structured to guide the liquid to the liquid chamber.

6. The household appliance of claim 5, wherein the two radial walls converge toward one another and are joined at a pointed end that points toward the liquid chamber.

7. The household appliance of claim 6, wherein the pointed end of each of the plurality of elements in one of the at least two rows points into a space between adjacent ones of the plurality of elements in an adjacent one of the at least two rows.

8. The household appliance of claim 5, wherein the plurality of elements of each of the at least two rows are annularly, peripherally distributed elements and wherein one of the at least two rows peripherally overlaps with the elements of the other of the at least two rows.

9. The household appliance of claim 1, wherein the seal contact surface rests directly on an outer periphery of the shaft.

10. The household appliance of claim 1, wherein the household appliance comprises a device for caring for items of laundry and the rotatable component further comprises a laundry drum.

11. The household appliance of claim 1, wherein the plurality of elements are formed on the shaft contact surface.

12. The household appliance of claim 1, wherein the plurality of elements are formed on the shaft contact surface and the seal contact surface.

13. The household appliance of claim 1, wherein each of the plurality of elements is symmetric about an axis that is parallel to an axis of rotation of the shaft.

14. A bearing device comprising:

a stationary component;

a metallic bearing;

a rotatable component rotatably mounted on the stationary component by the metallic bearing;

a shaft connected to the rotatable component, the shaft having a shaft contact surface;

a seal comprising a seal contact surface in contact with the shaft contact surface, wherein the shaft is rotatable relative to the seal such that the seal contact surface slides on the shaft contact surface; and a pump structured to convey liquid from an intermediate space between the seal contact surface and the shaft contact surface in an axial direction of the rotatable component upon rotation of the rotatable component, wherein the pump further comprises a plurality of elements provided on at least one of the shaft contact surface and the seal contact surface, wherein each of the plurality of elements comprises two radial walls converging toward one another in the axial direction of the rotatable component, wherein the plurality of elements are arranged in at least two rows adjacent one another, and wherein the plurality of elements in each row of the at least two rows are staggered relative to the plurality of elements in each adjacent row.

15. The bearing device of claim 14, wherein the pump comprises a radial depression guide structured to conduct liquid out of the intermediate space in the axial direction of the rotatable component.

16. The bearing device of claim 14, wherein the plurality of elements are formed on the seal contact surface.

17. The bearing device of claim 14, wherein the plurality of elements are formed on the shaft contact surface.

18. The bearing device of claim 14, wherein the plurality of elements are formed on the shaft contact surface and the seal contact surface.

19. The bearing device of claim 14, wherein the pump is structured to convey liquid out of the intermediate space in the axial direction of the rotatable component when the rotatable component is rotated in either of two directions of rotation.

20. The bearing device of claim 14, wherein the seal contact surface rests directly on an outer periphery of the shaft.

21. The bearing device of claim 14, wherein the pump further comprises guides defined between the plurality of elements that are structured to guide the liquid in the axial direction of the rotatable component.

22. The bearing device of claim 21, wherein the plurality of elements of each of the at least two rows are annularly, peripherally distributed elements and wherein one of the at least two rows peripherally overlaps with the elements of the other of the at least two rows.

23. The bearing device of claim 21, wherein the radial walls converge toward one another and are joined at a pointed end that points in the axial direction of the rotatable component.

24. The bearing device of claim 23, wherein the pointed end of each of the plurality of elements in one of the at least two rows points into a space between adjacent ones of the plurality of elements in an adjacent one of the at least two rows.

25. The bearing device of claim 14, wherein each of the plurality of elements is symmetric about an axis that is parallel to an axis of rotation of the shaft.

26. A water-conducting household appliance comprising:

a liquid chamber;

a stationary component;

a metallic bearing;

a rotatable component rotatably mounted on the stationary component of the household appliance by the metallic bearing;

a shaft connected to the rotatable component;

a seal that seals the metallic bearing from the liquid chamber, the seal comprising a seal contact surface in contact with a shaft contact surface of the shaft, wherein the shaft is rotatable relative to the seal and the seal contact surface slides on the shaft contact surface; and a pump on the contact surface of the shaft that conveys liquid from an intermediate space between contact surfaces to the liquid chamber upon rotation of the rotatable component, wherein the pump comprises a plurality of elements provided on at least one of the shaft contact surface and the seal contact surface, wherein the pump comprises guides between the plurality of elements that guide the liquid to the liquid chamber, and wherein the plurality of elements comprises at least two rows of annularly, peripherally distributed elements and wherein one of the at least two rows is staggered relative to the other of the at least two rows.

* * * * *